US010741320B2

(12) United States Patent
Lee et al.

(10) Patent No.: US 10,741,320 B2
(45) Date of Patent: Aug. 11, 2020

(54) COIL COMPONENT

(71) Applicant: SAMSUNG ELECTRO-MECHANICS CO., LTD., Suwon-si, Gyeonggi-do (KR)

(72) Inventors: Hwan Soo Lee, Suwon-si (KR); Yoon Hee Cho, Suwon-si (KR); Sung Min Song, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 274 days.

(21) Appl. No.: 15/826,012

(22) Filed: Nov. 29, 2017

(65) Prior Publication Data

US 2019/0019615 A1 Jan. 17, 2019

(30) Foreign Application Priority Data

Jul. 12, 2017 (KR) ..... 10-2017-0088182

(51) Int. Cl.

| | |
|---|---|
| ***H01F 27/29*** | (2006.01) |
| ***H01F 27/28*** | (2006.01) |
| ***H01F 27/32*** | (2006.01) |
| ***H01F 27/255*** | (2006.01) |
| ***H01F 17/00*** | (2006.01) |

(52) U.S. Cl.

CPC ..... *H01F 27/2804* (2013.01); *H01F 17/0013* (2013.01); *H01F 27/255* (2013.01); *H01F 27/29* (2013.01); *H01F 27/292* (2013.01); *H01F 27/32* (2013.01); *H01F 27/324* (2013.01); *H01F 2027/2809* (2013.01)

(58) Field of Classification Search

CPC ..... H01F 5/00; H01F 27/00–36
USPC ..... 336/65, 83, 90, 96, 200, 212, 232–234
See application file for complete search history.

(56) References Cited

U.S. PATENT DOCUMENTS

| | | | | |
|---|---|---|---|---|
| 6,373,368 | B1 | 4/2002 | Shikama et al. | |
| 2009/0045905 | A1 | 2/2009 | Nakagawa et al. | |
| 2012/0062348 | A1 | 3/2012 | Hashimoto | |
| 2013/0222101 | A1* | 8/2013 | Ito ..... | H01F 17/04 336/83 |

(Continued)

FOREIGN PATENT DOCUMENTS

| | | | |
|---|---|---|---|
| JP | 2001-155950 | A | 6/2001 |
| JP | 2003-318053 | A | 11/2003 |

(Continued)

OTHER PUBLICATIONS

Japanese Office Action dated Aug. 21, 2018 issued in Japanese Patent Application No. 2017-233491 (with English translation).

(Continued)

*Primary Examiner* — Tuyen T Nguyen
(74) *Attorney, Agent, or Firm* — Morgan, Lewis & Bockius LLP

(57) ABSTRACT

A coil component includes: a coil part including a coil conductor; and a body formed adjacently to the coil part and including first and second magnetic powder particles having different average particle sizes, wherein an average particle size of the first magnetic powder particles is smaller than an interval between adjacent patterns of the coil conductor, and an average particle size of the second magnetic powder particles is greater than the interval between the adjacent patterns of the coil conductor.

20 Claims, 6 Drawing Sheets

(56) References Cited

U.S. PATENT DOCUMENTS

| | | | | |
|---|---|---|---|---|
| 2013/0249664 | A1 | 9/2013 | Tonoyama et al. | |
| 2014/0009254 | A1* | 1/2014 | Ohkubo | H01F 27/2804 336/192 |
| 2014/0062636 | A1 | 3/2014 | Yang et al. | |
| 2016/0126004 | A1 | 5/2016 | Yang et al. | |
| 2016/0189863 | A1 | 6/2016 | Park et al. | |
| 2016/0247624 | A1 | 8/2016 | Seo et al. | |
| 2016/0379750 | A1* | 12/2016 | Hamada | H01F 27/02 336/220 |
| 2018/0268990 | A1* | 9/2018 | Lee | H01F 27/29 |

FOREIGN PATENT DOCUMENTS

| | | | |
|---|---|---|---|
| JP | 2005-32976 | A | 2/2005 |
| JP | 2012-064683 | A | 3/2012 |
| JP | 2013-201375 | A | 10/2013 |
| JP | 2014-013815 | A | 1/2014 |
| JP | 2016-004917 | A | 1/2016 |
| JP | 2016-122836 | A | 7/2016 |
| KR | 10-0998814 | B1 | 12/2010 |
| KR | 10-2014-0029656 | A | 3/2014 |
| KR | 10-1607026 | B1 | 3/2016 |
| KR | 10-2016-0102657 | A | 8/2016 |

OTHER PUBLICATIONS

Office Action issued in corresponding Japanese Application No. 2017-233491, dated Feb. 26, 2019.
Korean Office Action dated Jul. 19, 2018 issued in Korean Patent Application No. 10-2017-0088182 (with English translation).

* cited by examiner

III-III'

COIL COMPONENT

CROSS-REFERENCE TO RELATED APPLICATION(S)

This application claims benefit of priority to Korean Patent Application No. 10-2017-0088182 filed on Jul. 12, 2017 in the Korean Intellectual Property Office, the disclosure of which is incorporated herein by reference in its entirety.

BACKGROUND

1. Field

The present disclosure relates to a coil component.

2. Description of Related Art

In accordance with an increase in applications of wireless power transmitting technology, various attempts at improving the efficiency of power amplifiers have been undertaken, and among these attempts, research into envelope tracking (ET) technology using active voltage control has mainly been conducted.

In an output stage of an envelope tracker integrated circuit (ET IC) for implementing the envelope tracking (ET) technology, a power inductor and a bead, as well as a multilayer ceramic capacitor, have generally been used in order to supply power to the power amplifier and to prevent high frequency noise (50 MHz or more, for example, 80 to 130 MHz) from being transferred to the power amplifier during operations thereof.

SUMMARY

An aspect of the present disclosure may provide a coil component capable of providing high self resonance frequency (SRF) characteristics for removing high frequency noise while having an excellent inductance.

According to an aspect of the present disclosure, a coil component may include: a coil part including a coil conductor; and a body formed adjacently to the coil part and including first and second magnetic powder particles having different average particle sizes, wherein an average particle size of the first magnetic powder particles is smaller than an interval between adjacent patterns of the coil conductor, and an average particle size of the second magnetic powder particles is greater than the interval between the adjacent patterns of the coil conductor.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
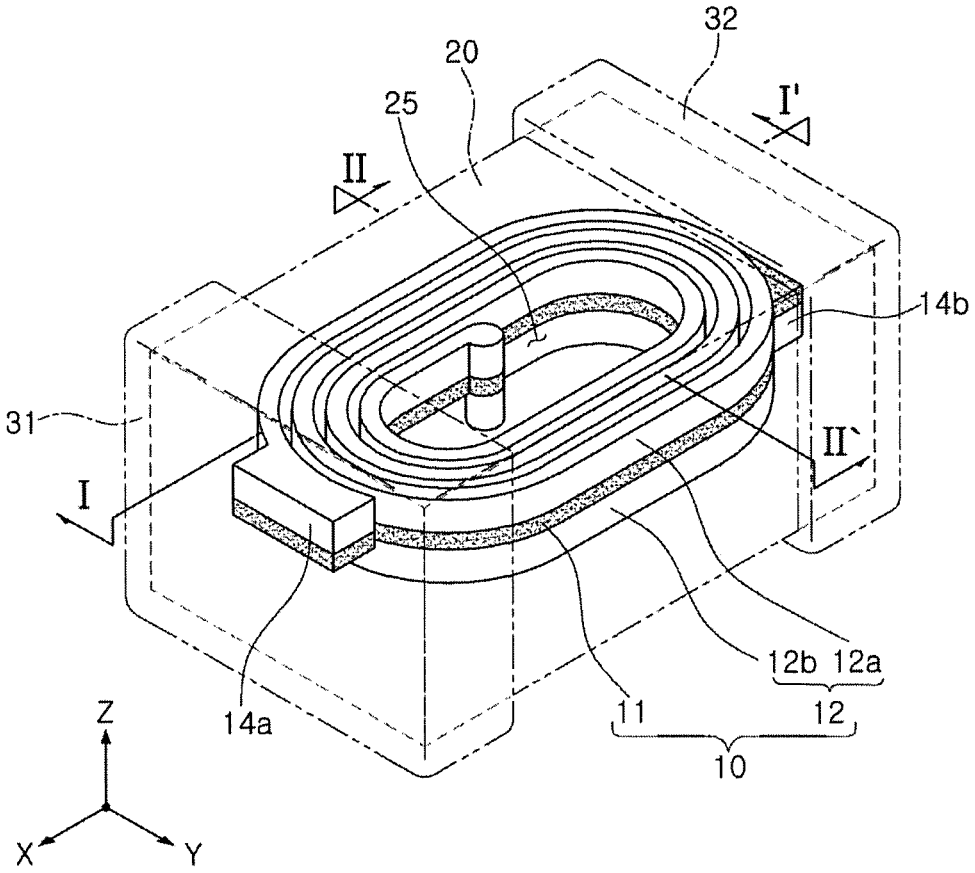
FIG. 1 shows a schematic perspective view illustrating a coil component according to an exemplary embodiment in the present disclosure so that a coil part of the coil component is viewed.

FIG. 1 shows a schematic perspective view illustrating a coil component according to an exemplary embodiment in the present disclosure so that a coil part of the coil component is viewed.

In the following description provided with reference to FIG. 1, a 'length' direction refers to an 'X' direction of FIG. 1, a 'width' direction refers to a 'Y' direction of FIG. 1, and a 'thickness' direction refers to a 'Z' direction of FIG. 1.

Referring to FIG. 1, the coil component according to an exemplary embodiment in the present disclosure may include a coil part 10 including a coil conductor 12, a body 20 formed adjacently to the coil part 10 to constitute an appearance of the coil component, and first and second external electrodes 31 and 32 formed on outer surfaces of the body 20.

The coil part 10 may include a coil substrate 11 and first and second coil conductors 12*a* and 12*b* formed on one surface of the coil substrate 11 and the other surface of the coil substrate opposing one surface of the coil substrate 11, respectively.

The first and second coil conductors 12*a* and 12*b* may be planar coils having a spiral shape, and may be electrically connected to each other through an internal via 13 (FIG. 2B) penetrating through the coil substrate 11.

The first and second coil conductors 12*a* and 12*b* may be formed on the coil substrate 11 by an electroplating method. However, the first and second coil conductors 12*a* and 12*b* are not necessarily limited thereto, but may be formed by other suitable processes that may accomplish a similar effect.

The first and second coil conductors 12*a* and 12*b* may be formed of a metal having excellent electrical conductivity, for example, silver (Ag), palladium (Pd), aluminum (Al), nickel (Ni), titanium (Ti), gold (Au), copper (Cu), platinum (Pt), or alloys thereof, but are not necessarily limited thereto.

One end portion of the first coil conductor 12*a* may be extended to form a first lead 14*a*, and the first lead 14*a* may be exposed to one end surface of the body 20 in the length L direction (i.e. x direction). In addition, one end portion of the second coil conductor 12*b* may be extended to form a second lead 14*b*, and the second lead 14*b* may be exposed to the other end surface of the body 20 in the length L direction (i.e. x direction). However, the first and second leads 14*a* and 14*b* are not necessarily limited thereto, and may be exposed to at least one surface of the body 20.

The first and second coil conductors 12*a* and 12*b* may be coated with a coil insulating layer 17, such that they may not be in direct contact with a magnetic material forming the body 20. The coil insulating layer 17 may include one or more selected from the group consisting of epoxy, polyimide, and liquid crystalline polymer (LCP), but is not necessarily limited thereto.

The coil substrate 11 may be, for example, a polypropylene glycol (PPG) substrate, a ferrite substrate, a metal-based soft magnetic substrate, or the like. A through-hole may be formed in a central portion of the coil substrate 11, and may be filled with a magnetic material to form a core part 25. When the core part 25 filled with the magnetic material is formed as described above, an area of a magnetic body through which magnetic flux passes may be increased to further improve an inductance L.

However, the coil part 10 does not necessarily include the coil substrate 11, but may also be formed of a metal wire without including the coil substrate.

The external electrodes 31 and 32 may serve to electrically connect the coil component to a circuit board, or the like, when the coil component is mounted on the circuit board, or the like, and may include first and second external electrodes 31 and 32 connected to a pair of leads of the coil conductor 12, respectively.

The external electrodes 31 and 32 may be formed of a metal having excellent electrical conductivity, for example, silver (Ag), palladium (Pd), aluminum (Al), nickel (Ni), titanium (Ti), gold (Au), copper (Cu), platinum (Pt), tin (Sn), or alloys thereof.

A method of forming the external electrodes and a specific shape of the external electrodes are not particularly limited. For example, the external electrodes may be formed to have a cross-sectional C shape along x direction using a dipping method.

Figure 2A:
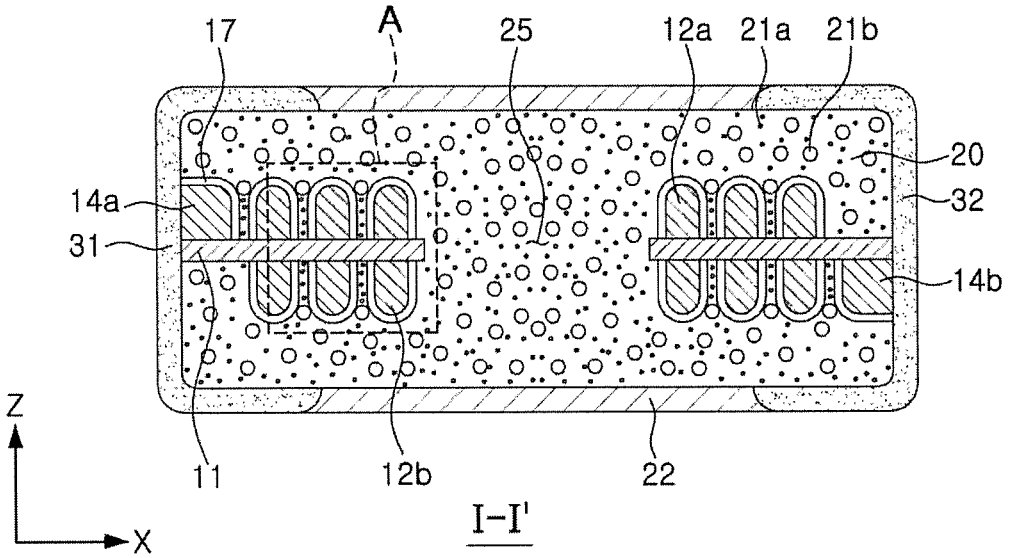
FIG. 2A shows a schematic cross-sectional view taken along line I-I' of FIG. 1.
Figure 2B:
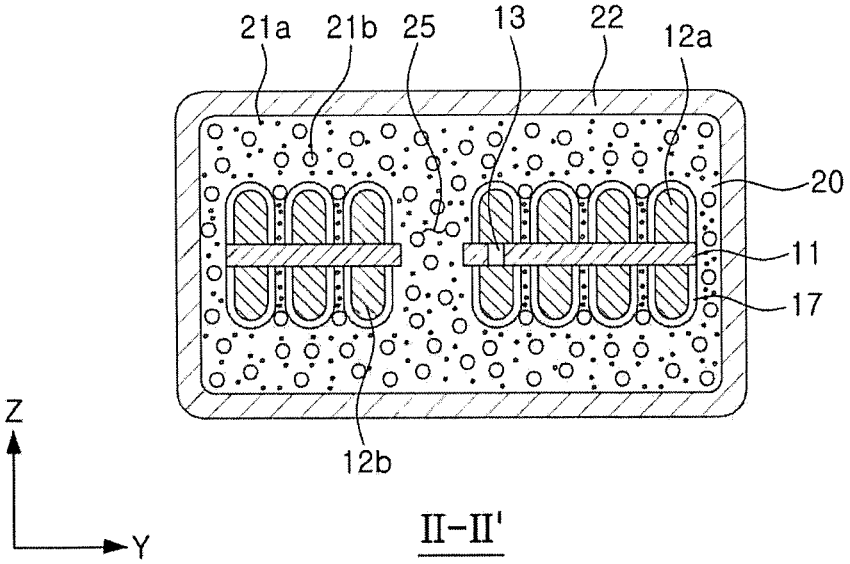
FIG. 2B shows a schematic cross-sectional view taken along line II-II' of FIG. 1.

FIG. 2A shows a schematic cross-sectional view taken along line I-I' of FIG. 1, and FIG. 2B shows a schematic cross-sectional view taken along line II-II' of FIG. 1.

Referring to FIGS. 2A and 2B, the body 20 may be formed adjacently to the coil part 10 to constitute the appearance of the coil component, and may have an approximately hexahedral shape including two end surfaces opposing each other in the length direction, two side surfaces opposing each other in the width direction, and upper and lower surfaces opposing each other in the thickness direction, but is not limited thereto.

The body 20 may include first and second magnetic powder particles 21*a* and 21*b* having different average particle sizes. The first and second magnetic powder particles 21*a* and 21*b* may be dispersed and included in a thermosetting resin. Here, the thermosetting resin may be, for example, an epoxy resin, a polyimide resin, or the like, but is not necessarily limited thereto.

In the present disclosure, an average particle size of the first magnetic powder particles 21*a* may be smaller than an interval between adjacent patterns of the coil conductor, and an average particle size of the second magnetic powder particles 21*b* may be greater than the interval between the adjacent patterns of the coil conductor. Therefore, a coil component capable of implementing high self resonance frequency (SRF) characteristics for removing high frequency noise while having an excellent inductance may be provided. This will hereinafter be described in more detail.

The following Equation relates to SRF characteristics of the coil component.

$$SRF=\frac{1}{2\pi\sqrt{LC}} \quad \text{[Equation 1]}$$

Here, L is inductance, and C is capacitance.

As represented in Equation 1, it is necessary to reduce a parasitic capacitance in order to move the SRF toward a high frequency. Therefore, in the present disclosure, an interval between coils was made to be relatively wide and magnetic powder particles were disposed between adjacent coils to reduce the parasitic capacitance and implement high SRF characteristics.

However, when the interval between the coils is excessively wide, an inductance value is reduced. Therefore, a method of implementing high SRF characteristics while appropriately maintaining an inductance value was devised. Resultantly, it was confirmed that the coil component may implement the high SRF while having the excellent inductance by simultaneously using fine powder particles having a relatively small average particle size and coarse powder particles having a relatively large average particle size and making the interval between the adjacent coils greater than the average particle size of the fine powder particles and smaller than the average particle size of the coarse powder particles.

As described above, the interval between the adjacent coils is greater than the average particle size of the first magnetic powder particles 21*a*, and the first magnetic powder particles 21*a* may thus be positioned in a space between the adjacent patterns of the coil conductor, resulting in a reduction in a parasitic capacitance. Meanwhile, when an upper surface of the coil conductor has a curved surface as illustrated in FIG. 2A, a definition of the space between the adjacent patterns may not be apparent. In this case, the space between the adjacent patterns may refer to a space between side surfaces (that is, linear portions of the coil conductor except for curved lines constituting the upper surface of the coil conductor in FIG. 2A) of the coil conductor (e.g. 12*a*).

The first magnetic powder particles 21*a* may be Fe based crystalline powder particles having an average particle size of 0.5 to 3 μm, and the second magnetic powder particles 21*b* may be FeCrSi based amorphous powder particles having an average particle size of 15 to 30 μm. However, the first magnetic powder particles 21*a* and the second magnetic powder particles 21*b* are not necessarily limited thereto.

Here, the average particle size refers to a particle size of the magnetic powder at a point at which a frequency is the largest, when the numbers of magnetic powder particles in each particle size are measured and a normal distribution curve or a distribution curve similar to the normal distribution curve for the numbers of magnetic powder particles is illustrated.

Meanwhile, a case in which the body includes two kinds of magnetic powder particles having different average particle sizes is described by way of example in the present exemplary embodiment, but a case in which the body includes three or more kinds of magnetic powder particles is not excluded. However, also in this case, the interval between the adjacent patterns of the coil conductor needs to be greater than an average particle size of magnetic powder particles having the smallest average particle size and be smaller than an average particle size of magnetic powder particles having the largest average particle size.

Figure 3:
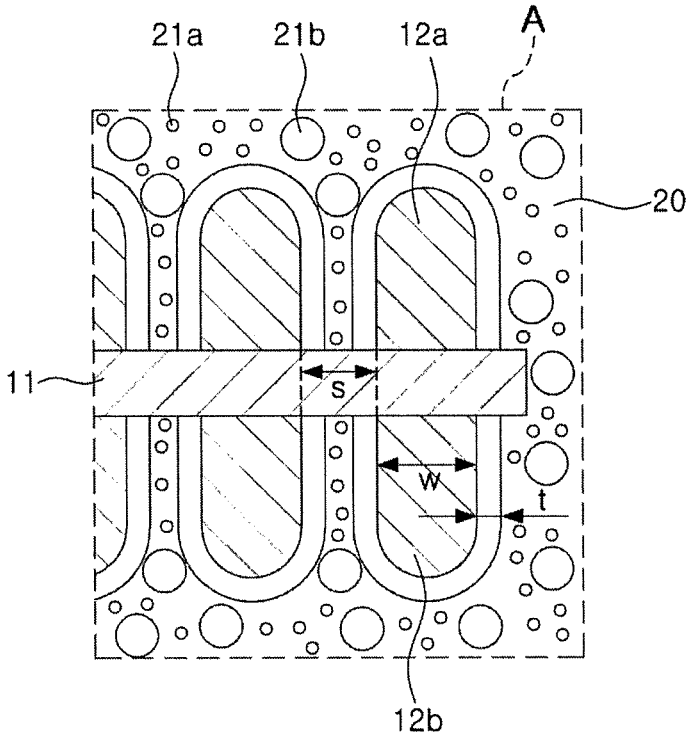
FIG. 3 shows an enlarged view illustrating the coil part of portion A of FIG. 2A.

FIG. 3 shows an enlarged view illustrating the coil part 10 at portion A of FIG. 2A.

Referring to FIG. 3, $s \geq w/4$ in which s is the interval between the adjacent patterns of the coil conductor and w is a width of the coil conductor. When s is smaller than w/4, it may be difficult to secure high SRF characteristics for removing high frequency noise.

In addition, s>2t in which s is the interval between the adjacent patterns and t is a thickness of the coil insulating layer. When s is equal to 2t or smaller than 2t, the coil insulating layer may fill the space between the adjacent patterns without allowing the first magnetic powder particles to be positioned in the filled space, and an inductance value may be reduced.

Figure 4:
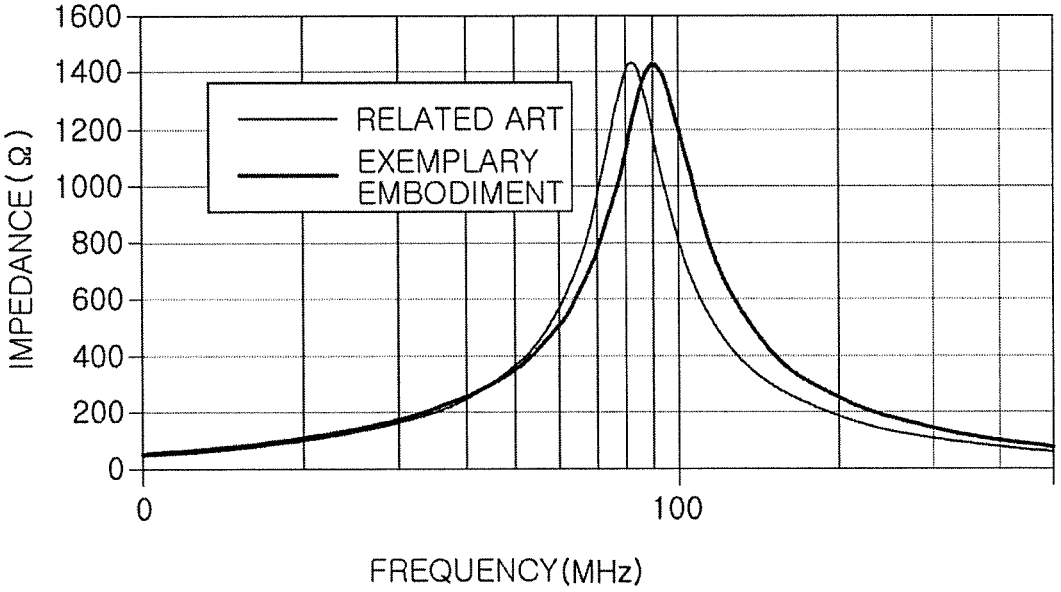
FIG. 4 shows a graph illustrating impedance vs frequency of a coil component according to the related art and a coil component according to an exemplary embodiment in the present disclosure.
Figure 5:
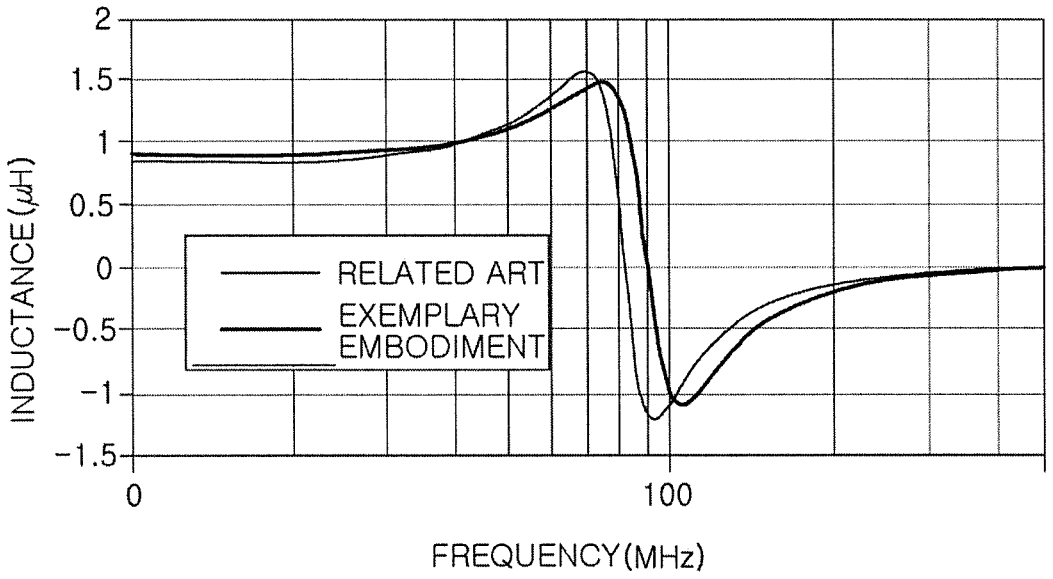
FIG. 5 shows a graph illustrating inductance vs frequency of the coil component according to the related art and the coil component according to an exemplary embodiment in the present disclosure.

FIG. 4 shows a graph illustrating impedance vs frequency of a coil component according to the related art and a coil component according to an exemplary embodiment in the present disclosure, and FIG. 5 shows a graph illustrating inductance vs frequency of the coil component according to the related art and the coil component according to an exemplary embodiment in the present disclosure. In FIGS. 4 and 5, only intervals between adjacent patterns are set to be different from each other in the coil component according to the related art and the coil component according to an exemplary embodiment in the present disclosure. In detail, in the coil component according to the related art, the interval between the adjacent patterns is set to be less than two times of the thickness of the coil insulating layer to allow the coil insulating layer to fill the space between the adjacent patterns, and in the coil component according to an exemplary embodiment in the present disclosure, the interval between the adjacent patterns is set to be greater than the average particle size of the first magnetic powder particles and be smaller than the average particle size of the second magnetic powder particles to allow the first magnetic powder particles to be positioned in the space between the adjacent patterns of the coil conductor.

It may be appreciated from FIG. 4 that in the coil component according to an exemplary embodiment in the present disclosure, an SRF is moved toward a high frequency by about 10 MHz. On the other hand, it may be appreciated that there is no large difference in a maximum value of an impedance, an impedance vs frequency shape, and the like. Meanwhile, it may be appreciated from FIG. 5 that an inductance and an inductance vs frequency shape is not significantly changed.

Figure 6:
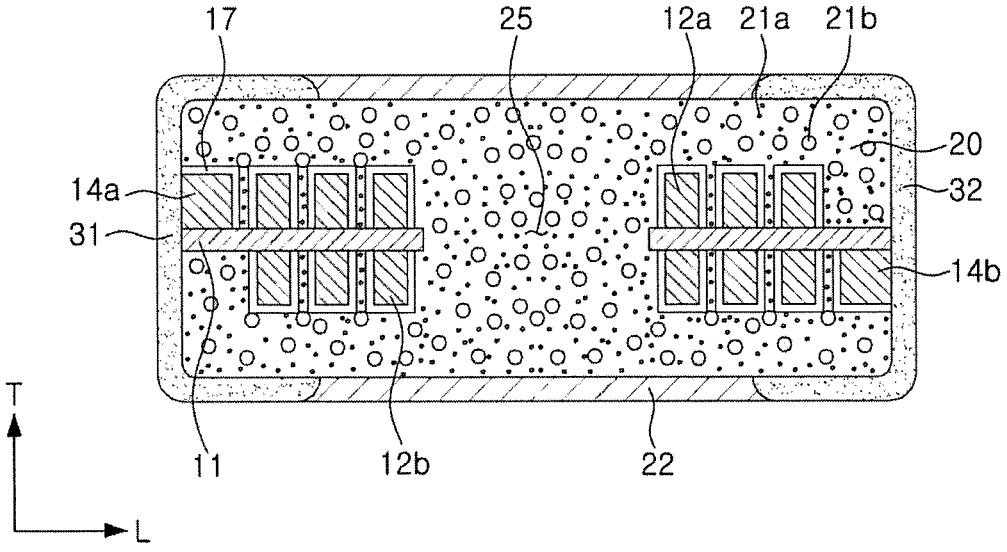
FIG. 6 shows a schematic cross-sectional view illustrating a coil component according to another exemplary embodiment in the present disclosure.

FIG. 6 shows a schematic cross-sectional view illustrating a coil component according to another exemplary embodiment in the present disclosure.

Referring to FIG. 6, a cross section of a coil conductor 12 may have a rectangular shape. In this case, an inductance of the coil component may be significantly increased.

Descriptions of features of the coil component according to the exemplary embodiment overlapping those described above will be omitted hereinafter.

Figure 7:
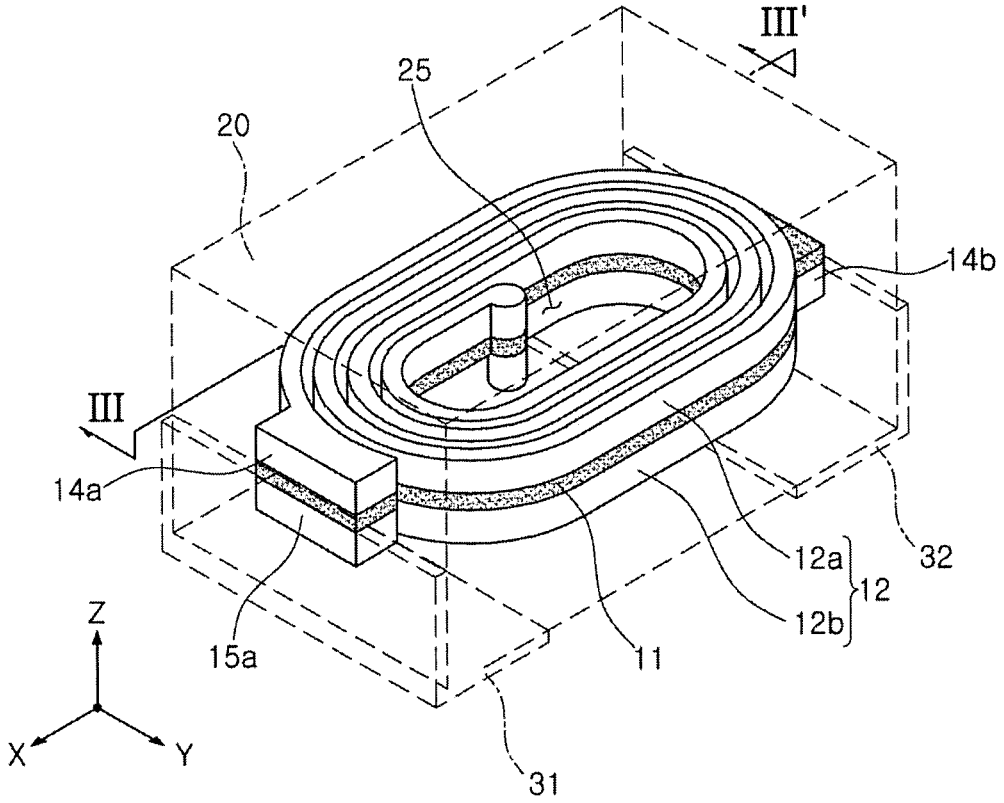
FIG. 7 shows a schematic perspective view illustrating a coil component according to another exemplary embodiment in the present disclosure so that a coil part of the coil component is viewed.
Figure 8:
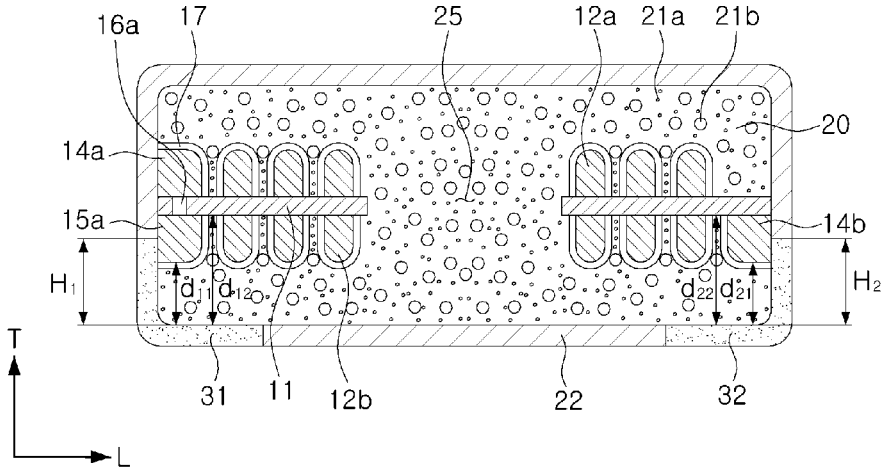
FIG. 8 shows a schematic cross-sectional view taken along line III-III' of FIG. 7.

FIG. 7 shows a schematic perspective view illustrating a coil component according to another exemplary embodiment in the present disclosure so that a coil part of the coil component is viewed, and FIG. 8 shows a schematic cross-sectional view taken along line of FIG. 7.

Referring to FIGS. 7 and 8, the coil component according to another exemplary embodiment in the present disclosure may further include a first dummy pad 15*a* formed in a position corresponding to that of the first lead 14*a* on the other surface of the coil substrate 11 and exposed through a first surface of the body 20. The first dummy pad 15*a* may be electrically connected to the first lead 14*a* through a first via 16*a* penetrating through the coil substrate 11.

The first dummy pad 15*a* may be formed of a metal having high electrical conductivity, for example, silver (Ag), palladium (Pd), aluminum (Al), nickel (Ni), titanium (Ti), gold (Au), copper (Cu), platinum (Pt), or alloys thereof. In addition, as an example of a process for forming the first dummy pad 15*a*, an electroplating method may be used. Alternatively, other processes known in the related art may also be used as long as an effect similar to that of the electroplating method may be accomplished.

In the coil component according to the related art, two coil conductors are formed on upper and lower surfaces of the coil substrate, respectively, such that the use of L shaped electrodes is limited and electrodes cannot but be formed over the entirety of end surfaces of the body. As a result, parasitic capacitance components between the coil conductors and electrode portions are excessive, such that SRF characteristics of the coil component are deteriorated.

Therefore, in another exemplary embodiment in the present disclosure, the first dummy pad 15*a* may be formed in the position corresponding to that of the first lead 14*a* on the other surface of the coil substrate 11 and be electrically connected to the first lead 14*a* through the first via 16*a*. Accordingly, in the coil component according to the present exemplary embodiment, first and second external electrodes 31 and 32 may be selectively formed on only an upper portion or a lower portion of the body 20 on the basis of the coil substrate 11, resulting in the use of L shaped electrodes.

According to another exemplary embodiment, the external electrodes 31 and 32 may include the first external electrode 31 covering at least a portion of the first dummy pad 15*a*, formed on the first surface of the body 20, and extended to a third surface of the body 20 connected to the first surface and the second external electrode 32 covering at least a portion of the second lead 14*b*, formed on a second surface of the body 20, and extended to a third surface of the body 20 connected to the second surface. Here, the first and second surfaces may be disposed to oppose each other while constituting end surfaces of the body 20, and the third surface may be provided as a mounted surface of the coil component.

According to another exemplary embodiment, a length $H_1$ of the first external electrode 31 formed on the first surface of the body may be greater than a length $d_{11}$ from the third surface of the body to the first dummy pad 15*a* and be smaller than a length $d_{12}$ from the third surface of the body to the coil substrate 11, and a length $H_2$ of the second external electrode 32 formed on the second surface of the body may be greater than a length $d_{21}$ from the third surface of the body to the second lead 14*b* and be smaller than a length $d_{22}$ from the third surface of the body to the coil substrate 11.

According to another exemplary embodiment, a surface insulating layer 22 may be formed on regions of the outer surfaces of the body 20 except for regions of the outer surfaces of the body 20 on which the first and second external electrodes 31 and 32 are formed. In this case, external exposure of the first lead 14*a*, or the like, may be effectively prevented, and alternating current (AC) leakage in a high frequency band (generally, a section of 1 MHz to SRF) at the time of an operation of a power management integrated circuit (PMIC) may be reduced. Here, the surface insulating layer 22 may include epoxy and may have a thickness of about 5 μm, but is not necessarily limited thereto.

Figure 9:
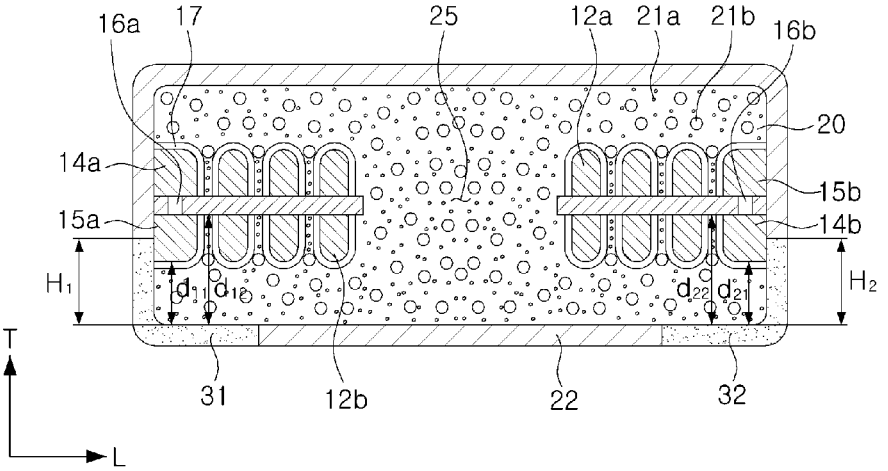
FIG. 9 shows a schematic cross-sectional view illustrating a coil component according to another exemplary embodiment in the present disclosure.

FIG. 9 is a schematic cross-sectional view illustrating a coil component according to another exemplary embodiment in the present disclosure.

Referring to FIG. 9, the coil component according to another exemplary embodiment in the present disclosure may further include a second dummy pad 15*b* formed in a position corresponding to that of the second lead 14*b* on one surface of the coil substrate 11 and exposed through the second surface of the body 20 and a second via 16*b* electrically connecting the second lead 14*b* and the second dummy pad 15*b* to each other.

Since the coil component according to the present exemplary embodiment may have a vertically symmetrical structure, surfaces of the body 20 on which the external electrodes 31 and 32 are to be formed do not need to be defined. Therefore, a cost and a time required for manufacturing the coil component may be reduced, and workability may be easy.

The components of the coil component according to the present exemplary embodiment may be the same as those of the coil component according to another exemplary embodiment described above except for the second dummy pad 15*b* and the second via 16*b*.

As set forth above, according to the exemplary embodiments in the present disclosure, a coil component in which functions of a power inductor and a bead are integrated with each other by implementing high SRF characteristics while having an excellent inductance may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a coil part including a coil conductor; and a body formed adjacently to the coil part and including first and second magnetic powder particles having different average particle sizes, wherein an average particle size of the first magnetic powder particles is smaller than an interval between adjacent patterns of the coil conductor, and an average particle size of the second magnetic powder particles is configured such that a length of a minor axis is greater than the interval between the adjacent patterns of the coil conductor.

2. The coil component of claim 1, wherein the first magnetic powder particles are positioned in a space between the adjacent patterns of the coil conductor.

3. The coil component of claim 1, wherein the first magnetic powder particles are Fe based crystalline powder particles having an average particle size of 0.5 to 3 μm.

4. The coil component of claim 1, wherein the second magnetic powder particles are FeCrSi based amorphous powder particles having an average particle size of 15 to 30 μm.

5. The coil component of claim 1, wherein $s \geq w/4$ in which s is the interval between the adjacent patterns and w is a width of the coil conductor.

6. The coil component of claim 1, further comprising a coil insulating layer surrounding the coil conductor.

7. The coil component of claim 6, wherein $s > 2t$ in which s is the interval between the adjacent patterns and t is a thickness of the coil insulating layer.

8. The coil component of claim 1, wherein the coil part includes:

a coil substrate; and first and second coil conductors formed on one surface of the coil substrate and the other surface of the coil substrate opposing one surface of the coil substrate, respectively.

9. The coil component of claim 8, wherein the first coil conductor has a first lead extended to be exposed through a first surface of the body, and the second coil conductor has a second lead extended to be exposed through a second surface of the body opposing the first surface of the body.

10. The coil component of claim 9, further comprising:

a first dummy pad formed in a position corresponding to that of the first lead on the other surface of the coil substrate and exposed through the first surface of the body; and a first via electrically connecting the first lead and the first dummy pad to each other.

11. The coil component of claim 10, further comprising:

a second dummy pad formed in a position corresponding to that of the second lead on one surface of the coil substrate and exposed through the second surface of the body; and a second via electrically connecting the second lead and the second dummy pad to each other.

12. The coil component of claim 9, further comprising first and second external electrodes disposed on the first and second surfaces of the body, respectively, and electrically connected to the first and second leads, respectively.

13. The coil component of claim 12, wherein the first external electrode covers at least a portion of the first dummy pad and is extended to a third surface of the body connected to the first surface of the body, and the second external electrode covers at least a portion of the second lead and is extended to a third surface of the body connected to the second surface of the body.

14. The coil component of claim 13, wherein lengths of the first and second external electrodes formed on the first and second surfaces, respectively, are greater than lengths from the third surface to the first dummy pad and the second lead and are smaller than a length from the third surface to the coil substrate.

15. The coil component of claim 10, further comprising a surface insulating layer formed on regions of the outer surfaces of the body except for regions of the outer surfaces of the body on which the first and second external electrodes are formed.

16. The coil component of claim 8, wherein the first and second coil conductors are electrically connected to each other through an internal via penetrating through the coil substrate.

17. The coil component of claim 1, wherein the coil conductor has a rectangular shape.

18. The coil component of claim 12, wherein the first and second external electrodes have cross-sectional C shapes.

19. The coil component of claim 12, wherein the first and second external electrodes have cross-sectional L shapes.

20. The coil component of claim 1, wherein the first and second magnetic powder particles have a substantially same shape as each other.

* * * * *